US008578827B1

(12) United States Patent
Jaroche

(10) Patent No.: US 8,578,827 B1
(45) Date of Patent: Nov. 12, 2013

(54) ADJUSTABLE CUTTING GUIDE

(76) Inventor: Thomas Jaroche, Andover, MA (US)

( * ) Notice: Subject to any disclaimer, the term of this patent is extended or adjusted under 35 U.S.C. 154(b) by 238 days.

(21) Appl. No.: 13/115,196

(22) Filed: May 25, 2011

(51) Int. Cl.

| | |
|---|---|
| ***B26D 5/42*** | (2006.01) |
| ***B26D 7/02*** | (2006.01) |
| ***B25B 1/06*** | (2006.01) |
| ***B27B 5/00*** | (2006.01) |

(52) U.S. Cl.
USPC ..... 83/382; 83/455; 269/254 CS; 144/278.1

(58) Field of Classification Search
USPC ..... 83/455, 456, 745, 574, 453, 454, 83/375–377, 382; 269/43, 246, 237–239, 269/254 CS, 317, 97–98; 144/287.1, 144/286.1–287, 306, 307
See application file for complete search history.

(56) References Cited

U.S. PATENT DOCUMENTS

| | | | | | |
|---|---|---|---|---|---|
| 119,113 | A | * | 9/1871 | Branch | 144/87 |
| 707,803 | A | * | 8/1902 | Smith | 269/214 |
| 722,677 | A | * | 3/1903 | Crippen | 269/221 |
| 884,004 | A | * | 4/1908 | Bennett | 144/278.1 |
| 1,372,833 | A | * | 3/1921 | Sauer | 269/221 |
| 2,525,204 | A | * | 10/1950 | Calabro | 100/214 |
| 2,620,696 | A | * | 12/1952 | Alves | 81/300 |
| 2,773,523 | A | | 12/1956 | Hopla | |
| 2,818,095 | A | * | 12/1957 | Stahl et al. | 269/162 |
| 3,389,724 | A | | 6/1968 | Paul | |
| 3,909,889 | A | * | 10/1975 | Emerson | 24/514 |
| 4,095,632 | A | | 6/1978 | Raulinaitis | |
| 4,487,403 | A | | 12/1984 | Burge | |
| 4,831,905 | A | * | 5/1989 | Murchison | 81/485 |
| D303,752 | S | | 10/1989 | Gleeson et al. | |
| 5,398,535 | A | * | 3/1995 | Giffin | 72/392 |
| 5,699,711 | A | | 12/1997 | Gold | |
| 6,079,309 | A | | 6/2000 | Molburg | |
| 2009/0272241 | A1 | * | 11/2009 | Aigner | 83/447 |

* cited by examiner

*Primary Examiner* — Sean Michalski
*Assistant Examiner* — Jonathan G Riley
(74) *Attorney, Agent, or Firm* — Montgomery Patent & Design; Robert C. Montgomery

(57) ABSTRACT

A clamping cutting guide to assist a carpenter in performing various wood techniques comprises a guide plate, a pair of guide rods, and a spring-loaded clamping portion. The guide rods extend perpendicularly downward along side areas and are inserted into respective springs to provide a clamping force to the stationary guide plate and a mobile clamping plate. The cutting guide also comprises a pair of pivoting handles open the clamp portions during loading/unloading of a desired object to be cut, thereby allowing a user to operate the guide using a single hand.

19 Claims, 5 Drawing Sheets

ADJUSTABLE CUTTING GUIDE

RELATED APPLICATIONS

There are no related applications currently co-pending with the present application.

FIELD OF THE INVENTION

The present invention relates generally to adjustable cutting guides, and in particular, to an adjustable cutting guide with an automatic spring-loaded clamping mechanism.

BACKGROUND OF THE INVENTION

As any professional contractor will attest, nothing beats having the proper tool for a job. The proper tool can save time and money, produce a higher quality job, reduce damage to equipment, and provide increased safety for workers. This is particularly true in fields is which require the use of a power saw to crosscut a piece of dimensional lumber such as a two-by-four.

Many workers utilize a framing square to serve as a perpendicular guide when crosscutting lumber as described above. While this method does work, it is also plagued with problems. First, the square can easily move before or during the cut, which results in an erroneous cut and wasted material.

Second, this method forces the user to place their hand near the blade of the saw, which is a significant safety concern. Also, this method will not work at all when using other tools such as a router to produce dado cuts.

Various attempts have been made to provide cutting guides. Examples of these attempts can be seen by reference to several U.S. patents. U.S. Pat. No. 2,773,523, issued in the name of Hopla, describes a portable guide device for saws which removably attaches to a work piece and provides lateral and angular adjustability.

U.S. Pat. No. 3,389,724, issued in the name of Paul, describes an adjustable saw guide allowing cuts to be made on opposite sides of the work piece with removing the guide.

U.S. Pat. No. 5,699,711, issued in the name of Gold, describes a saw guide with an adjustable guide and a threaded clamping mechanism for securing the guide.

While these apparatuses fulfill their respective, particular objectives, each of these references suffer from one or more of the aforementioned disadvantages. Many such devices are large and bulky, which can make them difficult to transport and difficult to manipulate between cuts. Furthermore, many such devices provide an extensive range of adjustment mechanisms which results in increased time spent installing and removing the apparatus, even for simple tasks, making those apparatuses unsuited for simple, repetitious tasks. Accordingly, there exists a need for an adjustable saw cutting guide without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for an adjustable cutting guide which allows a user to quickly install and remove the apparatus in a manner providing simple, easy, and quick repetition of common basic cutting tasks. Thus, the object of the present invention is to solve the aforementioned disadvantages and provide for this need.

To achieve the above objectives, it is an object of the present invention to provide a clamping spring-loaded cutting guide providing outer edges against which a saw or other tool can slide in a parallel manner to obtain accurate cuts. The apparatus includes a guide plate for guiding the saw, a stationary clamp portion attached to the guide plate with a pair of rod assemblies, and a spring-loaded mobile clamp portion which slides along the rod assemblies between the guide plate and stationary clamp portion.

Another object of the present invention is to construct the guide plate of a metal material suitable for repeated use with a saw.

Yet still another object of the present invention is to provide highly accurate right-angle cuts by aligning a right-angle bracket of the apparatus against a side of a work piece.

Yet still another object of the present invention is to provide hands-free clamping attachment of the apparatus to a work piece with a plurality of first compression springs that provide a static upward force against the mobile clamp portion. The first springs bias the mobile clamp portion towards the guide plate so that the apparatus automatically clamps against a work piece which is passed between the guide plate and the mobile clamp portion.

Yet still another object of the present invention is to provide a finger opening within the mobile clamp portion allowing a user to quickly grip and pull the mobile clamp portion to install the apparatus over a work piece.

Yet still another object of the present invention is to provide mechanical assistance to the user when opening the mobile clamp portion with a plurality of second compression springs providing a small static downward force against the mobile clamp portion.

Yet still another object of the present invention is to provide a pair of corresponding high-friction surfaces along corresponding surfaces of the guide plate and mobile clamp portion to securely grip the work piece when installed.

Yet still another object of the present invention is to allow a user to quickly release or adjust the apparatus utilizing a single hand with a first handle and a second handle each removably and pivotingly connected to both clamp portions. The first and second handles provide a scissors-action that motions the mobile clamp portion downwardly from the guide plate.

Yet still another object of the present invention is to provide a method of utilizing the device that provides a unique means of utilizing the finger opening or handles to motion the mobile clamp portion downward away from the guide plate, sliding the apparatus over an end work piece, butting a side the work piece against the right-angle bracket if making a right-angle cross-cut or rotating the apparatus until obtaining a desired angle relative to the work piece to make an angled cut, releasing the finger opening or handles to clamp the work piece and provide automatic and "hands free" securement of the apparatus to the work piece, sliding an edge portion of a saw or other tool across an edge portion of the guide plate to perform a cutting task, and benefiting from a quick and portable means of accurately cutting a work piece.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
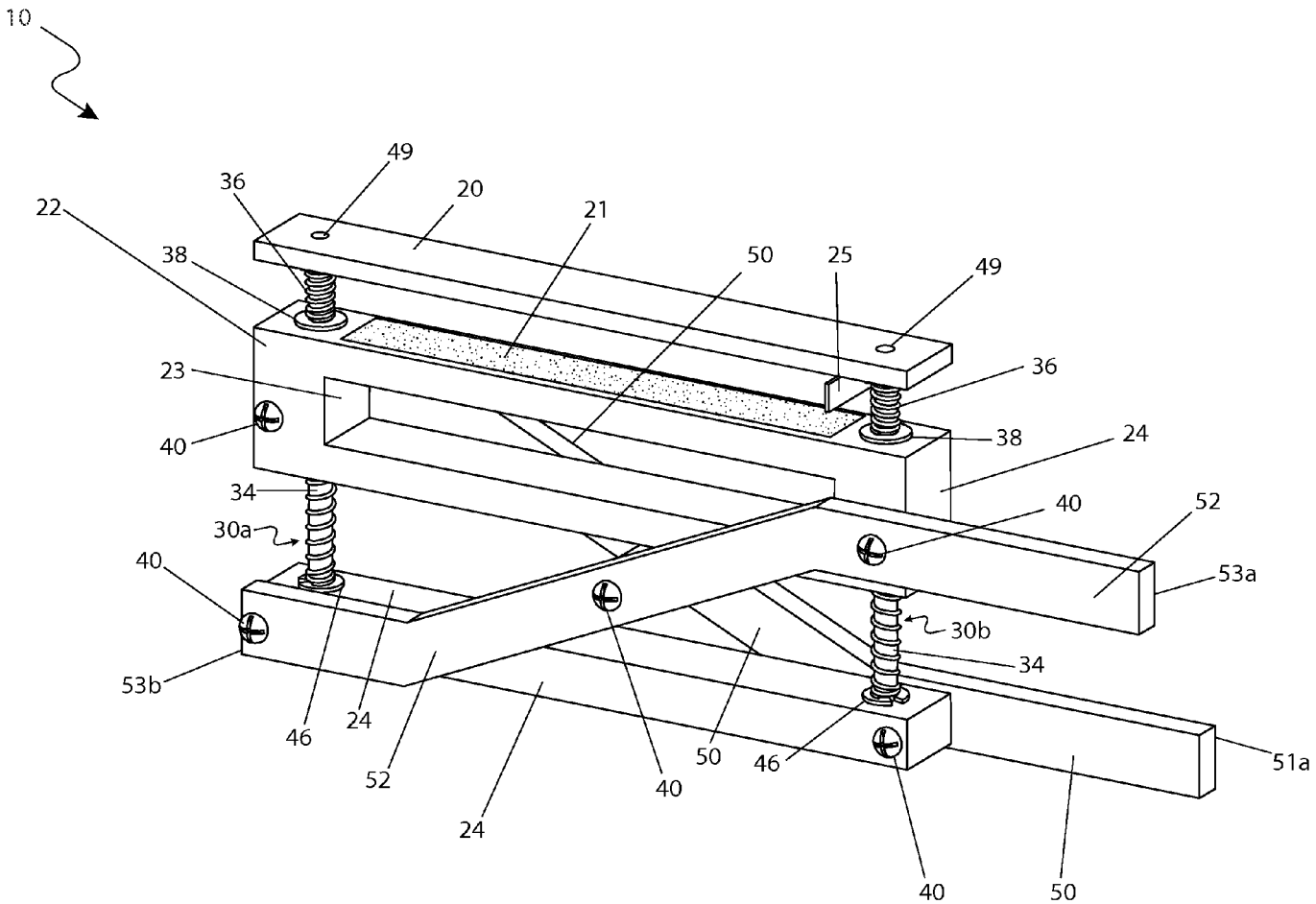
FIG. 1 is a front perspective view of an adjustable cutting guide 10, according to a preferred embodiment of the present invention.

10 fingerless gloves with integrated multi-source lighting system
10 adjustable cutting guide
20 guide plate
21 high-friction surface
22 mobile clamp portion
23 finger opening
24 stationary clamp portion
25 right-angle bracket
30*a* first guide rod assembly
30*b* second guide rod assembly
32 rod assembly aperture
34 first spring
36 second spring
37 guide rod
38 washer
39*a* first guide rod aperture
39*b* second guide rod aperture
40 shoulder bolt
42 nut fastener
43 jam-nut
46 snap ring
48 threaded region
49 threaded aperture
50 first handle
51*a* first handle proximal end
51*b* first handle distal end
52 second handle
53*a* second handle proximal end
53*b* second handle distal end
54*a* first handle mounting aperture
54*b* second handle mounting aperture
56 pivot spacer
100 board
105 saw/power tool
110 user

DETAILED DESCRIPTION OF THE PREFERRED EMBODIMENT

In accordance with the invention, the best mode is presented in terms of a preferred embodiment, herein depicted within FIGS. 1 through 5. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Figure 2:
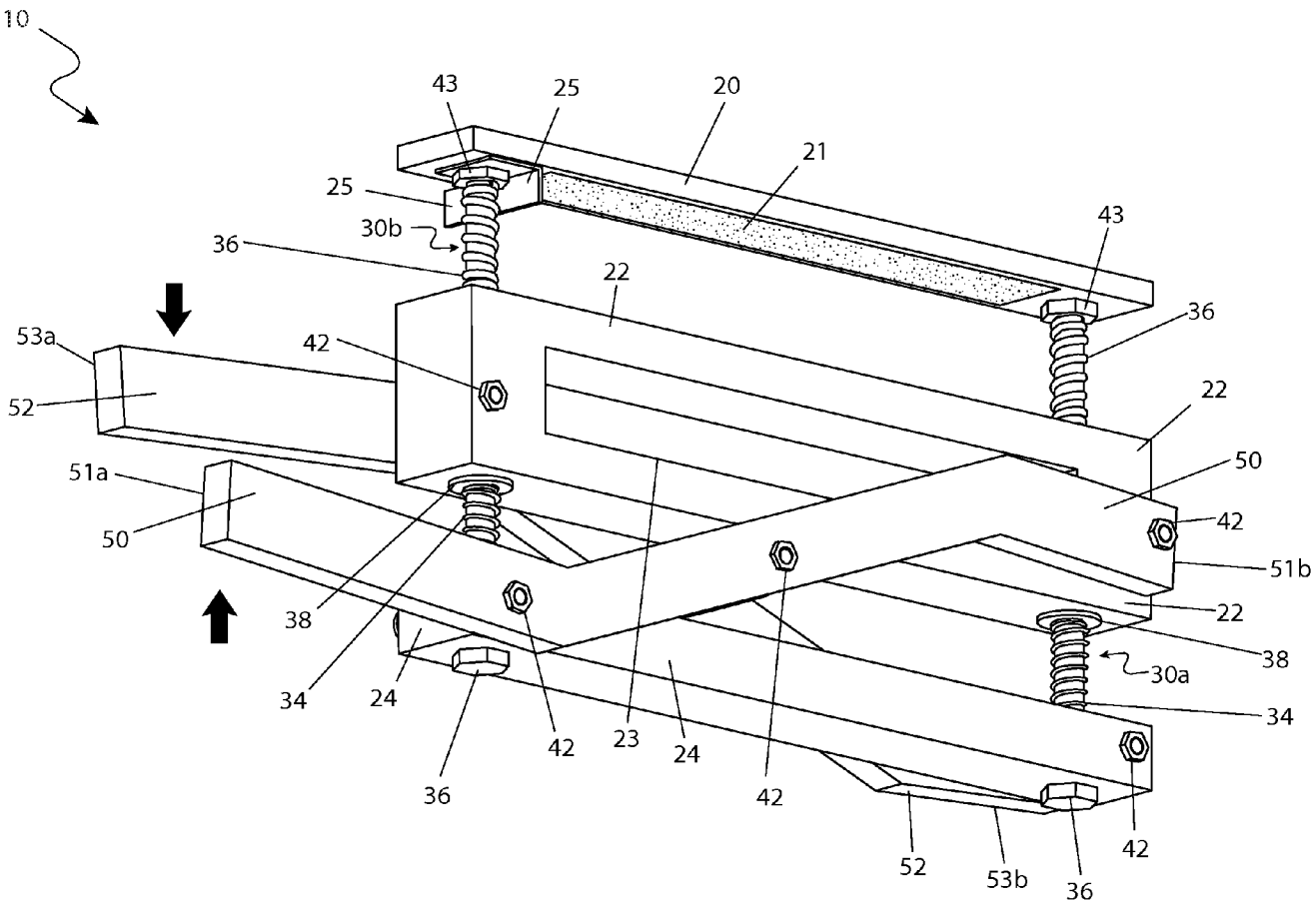
FIG. 2 is an upward-looking perspective view of the adjustable cutting guide 10, according to a preferred embodiment of the present invention.
Figure 3:
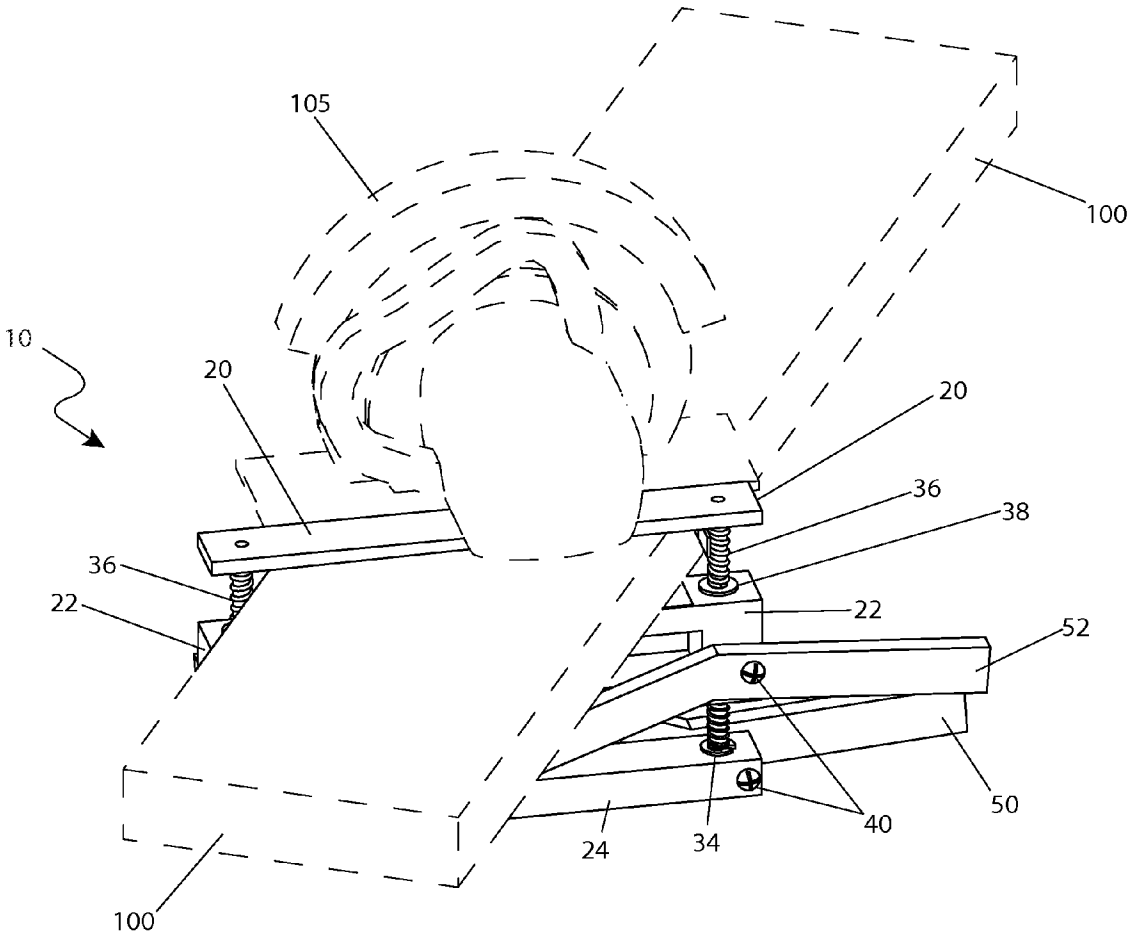
FIG. 3 is an environmental view of an adjustable cutting guide 10 depicting an in-use state, according to a preferred embodiment of the present invention.

Referring now to FIGS. 1, 2, and 3, perspective and environmental views of the adjustable cutting guide (herein described as the "apparatus") 10, according to a preferred embodiment of the present invention, are disclosed. The apparatus 10 provides an adjustable carpentry cutting guide comprising a clamping spring-loaded cutting guide to assist in performing carpentry wood cutting tasks such as, but not limited to: crosscut wood sawing, creating dado cuts, and the like, using various saws and power tools 105. The apparatus 10 comprises a guide plate 20 which is firmly clamped to a top surface of a wooden board 100 to be cut. Said guide plate 20 provides outer edges against which a saw/power tool 105 may slide against in a parallel manner to obtain an accurate cutting of said board 100. The apparatus 10 is envisioned to be introduced in various width sizes which correspond to a variety of standard lumber widths. The apparatus 10 may be utilized to perform a standard right-angle cross-cut via an integral right-angle bracket 25 portion of the guide plate 20, or may also be utilized to perform angled cuts of the board 100 up to forty-five degrees (45°) by simply rotating said apparatus 10 to a desired angle prior to clamping the board 100.

The apparatus 10 comprises a metal guide plate 20, a first guide rod assembly 30*a*, a second guide rod assembly 30*b*, a mobile clamp portion 22, a stationary clamp portion 24, a first handle 50, and a second handle 52. The guide plate 20 further comprises a rectangular steel or aluminum metal plate approximately one-eighth (%) of an inch in thickness. Additionally, said guide plate 20 comprises a pair of threaded apertures 49 to facilitate assembly of the respective guide rod assemblies 30*a*, 30*b*.

In use, the guide plate 20 is positioned above the board 100 while a mobile clamp portion 22 applies an opposing clamping force along a bottom surface of the board 100, thereby securing the board 100 between respective rectangular contact surfaces of said guide plate 20 and mobile clamp portions 22. The guide plate 20 and the mobile clamp portion 22 are joined along a vertical axis via the first 30*a* and second 30*b* guide rod assemblies, thereby maintaining a parallel relationship to each other. Said first 30*a* and second 30*b* guide rod assemblies extend perpendicularly downward through said guide plate 20 and mobile clamp portions 22 being affixed at outer end portions of each. The distal bottom end of each guide rod assembly 30*a*, 30*b* is anchored to a stationary clamp portion 24, thereby establishing a sturdy rectangular structure. The guide plate 22, mobile clamp portion 22, and stationary clamp portion 24 each comprise identical perimeter shapes and parallel horizontal surfaces. The mobile clamp portion 22 is located between the guide plate 20 and the stationary clamp portion 24, and is slidably movable along the guide rod assemblies 30*a*, 30*b*. The mobile clamp portion 22 comprises a rectangular structure having a center rectangular-shaped finger opening 23 which allows a user 110 to insert their fingers to open the apparatus 10 when being utilized without the handle portions 50, 52 installed (see FIG. 4).

Figure 5:
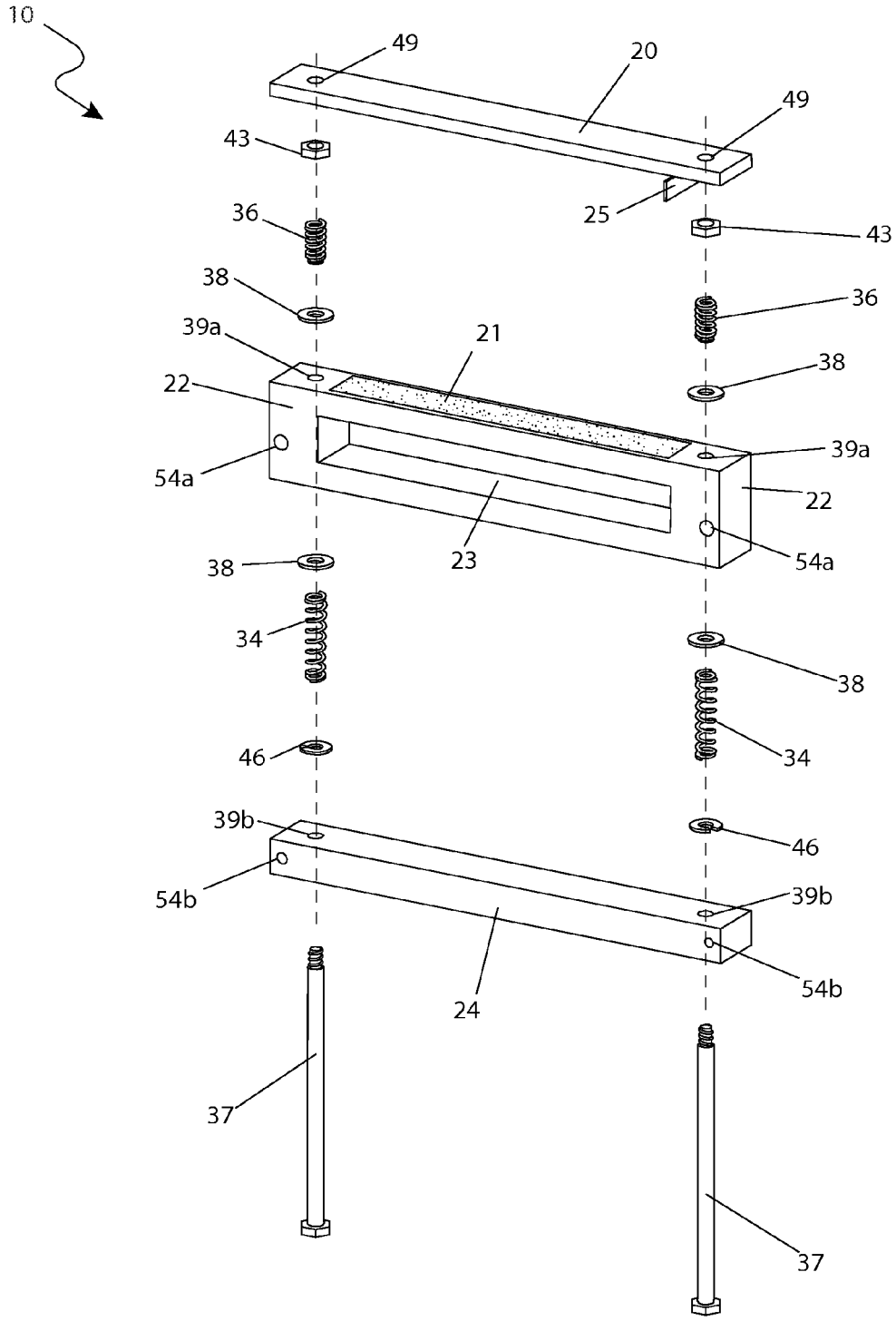

The guide rod assemblies 30*a*, 30*b* each comprise a first spring 34 positioned between the mobile clamp portion 22 and the stationary clamp portion 24 causing a motioning of the mobile clamp portion 22 towards the board 100 to securely clamp said board 100, thereby providing a "hands-free" clamping function (see FIG. 5). Said mobile 22 and stationary 24 clamp portions comprise rigid rectangular members preferably made in a plastic extrusion process; however, said clamp portions 22, 24 may also be introduced in other materials such as wood, aluminum, or the like with equal benefit.

The guide plate 20 and mobile clamp portions 22 further comprise respective high-friction surfaces 21 along opposing surfaces. Said high-friction surface 21 is envisioned to be an adhesively bonded or otherwise applied sandpaper-like product or equivalent rough coating designed to improve gripping to the clamped board 100.

The apparatus 10 further comprises a first handle 50 and a second handle 52 along side surfaces of the mobile 22 and stationary 24 clamp portions. The first handle 50 further comprises a first handle proximal end 51*a* and an opposing first handle distal end 51*b*. In a horizontally mirrored manner, the second handle 52 further comprises second handle proximal end 53*a* and second handle distal end 53*b* portions. In use, the first 51*a* and second 53*a* proximal end portions of the handles 50, 52 extend out from under a clamped board 100, thereby providing convenient grasping access to the apparatus 10 to release or clamp said board 100. Said handles 50, 52 are pivotingly attached to said mobile 22 and stationary 24 clamp portions, as well as being pivotingly attached to each other via a cylindrical pivot spacer portion 56 at a center area of said handles 50, 52, thereby providing a "scissors-action" to motion the mobile clamp portion 22 downwardly toward the stationary clamp portion 26 and allow a user 110 to easily release or adjust the board 100 using a single hand.

Figure 4:
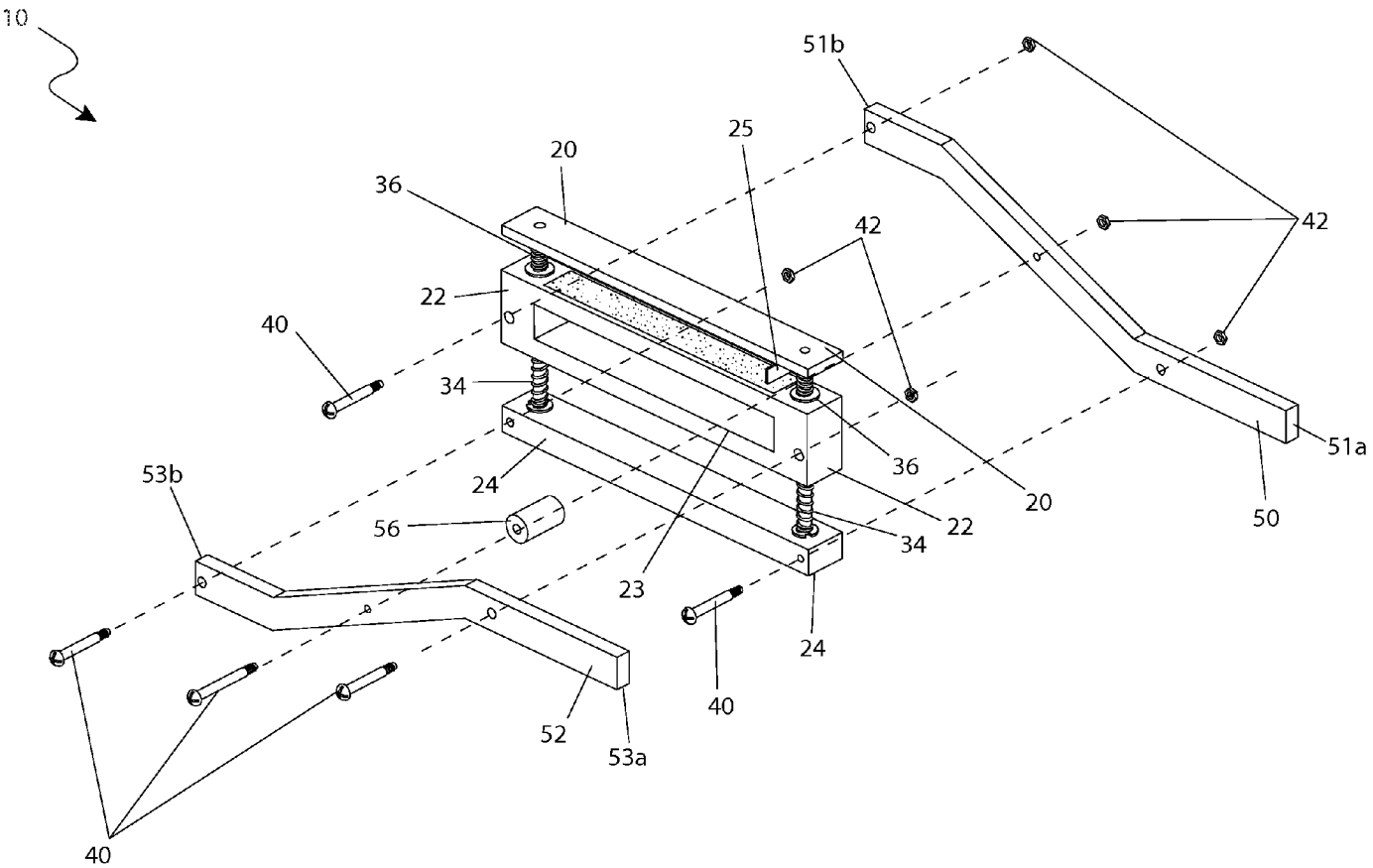
FIG. 4 is a partially exploded view of the adjustable cutting guide 10 depicting detachment of handle portions 50, 52, according to a preferred embodiment of the present invention; and, FIG. 5 is another exploded view of the adjustable cutting guide 10 depicting clamping portions, according to a preferred embodiment of the present invention.

Referring now to FIG. 4, a partially exploded view of the adjustable cutting guide 10 depicting detachment of the handle portions 50, 52, according to a preferred embodiment of the present invention, is disclosed. The apparatus 10 comprises a pair of removably attached handles 50, 52 which provide an outwardly extending grasping and clamping aid for the user 110. Each handle portion 50, 52 comprises a "Z"-shaped appendage which extends outwardly from under a clamped board 100 during use (see FIG. 3). Each handle 50, 52 is pivotingly affixed to both the mobile 22 and stationary 24 clamp portions via respective shoulder bolts 40 and nut fasteners 42. Additionally, the handles 50, 52 are affixed to each other at an intermediate position on opposing sides of the mobile 22 and stationary 24 clamp portions to produce a "scissors"-type movement relative to each other via a cylindrical pivot spacer 56, an additional shoulder bolt 40, and a respective nut fastener 42 (see FIG. 2). Such an arrangement enables a user 110 to squeeze the handles 50, 52 together using a single hand to motion the mobile clamp portion 22 downwardly away from the guide plate 20, thereby increasing a gap between, to load, reposition, or remove the board 100.

The apparatus 10 may be utilized with the handles 50, 52 removed if necessary, based upon space constraints or other environmental factors. The gap between the guide plate 20 and the mobile clamp portion 24 may be opened without the handles 50, 52 installed by inserting a user's 110 fingers through the center finger opening 23 to squeeze the mobile clamp portion 22 toward the stationary clamp portion 24.

Referring now to FIG. 5, another exploded view of the adjustable cutting guide 10 depicting clamping portions, according to a preferred embodiment of the present invention, is disclosed. The guide plate 20, mobile clamp portion 22, stationary clamp portion 24, and guide rods 37 are clearly illustrated here in an exploded state. The mobile clamp portion 22 further comprises a pair of vertical guide rod apertures 39*a* and a pair of horizontal handle mounting apertures 54*a*. Likewise, the stationary clamp portion 24 comprises a pair of second guide rod apertures 39*b* and a pair of second handle mounting apertures 54*b*. Said apertures 39*a*, 39*b*, 54*a*, 54*b* comprise cylindrical through-holes sized so as to provide sliding insertion of respective guide rods 37 and shoulder bolts 40 and are envisioned to be formed using common fabrication processes such as drilling, plastic molding, or plastic extruding, based upon a particular material selection and/or manufacturing costs.

Each guide rod assembly 30*a*, 30*b* comprises rugged metallic members including a first spring 34, a second spring 36, a guide rod 37, a pair of washers 38, a jam-nut fastener 43, and a snap-ring 46. Each guide rod 37 comprises a long bolt fastener having a common hex-head at a bottom end portion and a short threaded region 48 at a top end portion. The first spring 34 comprises a compression spring which provides a static upward force upon a bottom surface of the mobile clamp portion 22 to retain the board 100 in a clamped state (see FIG. 3). The second spring 36 comprises a shorter compression spring which is positioned between the guide plate 20 and the mobile clamp portion 22. Said second spring 36 provides a slight downward force to lower the mobile clamp portion 22 as the handle proximal ends 51*a*, 53*a* are being squeezed together to open the apparatus 10. Additionally, common washers 38 are positioned between said springs 34, 36 and the guide rod apertures 39*a*, 39*b* to improve distribution of the forces applied by said springs 34, 36.

The guide rod assemblies 30*a*, 30*b* each provide a means to assemble or disassemble the apparatus 10, as needed, by sequentially inserting onto the guide rod 37 the stationary clamp portion 24, a snap ring 46 to secure said stationary clamp portion 24, the first spring 34, a washer 38, the mobile clamp portion 22, another washer 38, the second spring 36, a jam-nut 43, and finally threading the threaded region 48 into the guide plate 20. The jam-nut 43 is utilized upon the threaded region 48 to position an end portion of the guide rod 37 flush with a top surface of the guide plate 20 (see FIG. 1).

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIG. 3.

The method of utilizing the apparatus 10 may be achieved by performing the following steps: procuring a model of the apparatus 10 having a correct width which corresponds to anticipated boards 100 to be cut; squeezing the handle proximal ends 51*a*, 53*a* together to open the gap between the guide plate 20 and the mobile clamp portion 22; sliding the apparatus 10 over an end portion of a board 100 or other object to be cut; butting a side edge of the board 100 against the right-angle bracket 25 if making a right-angle cross-cut or; rotating the apparatus 10 until obtaining a desired relative angle to the board 100 to make an angled cut; releasing the handle proximal ends 51*a*, 53*a* to allow the first spring 34 to motion the mobile clamp portion 22 upwardly to clamp the board 100; providing an automatic and "hands free" securement of the apparatus 10 upon the board 100 in a desired location; sliding an edge portion of the saw/power tool 105 across an edge portion of the guide plate 20 to perform a board-cutting task; and, benefiting from a quick and portable means of accurately cutting a board 100 afforded the user 110 of the present invention 10.

The method of utilizing the apparatus 10 with the handle portions 50, 52 removed may be achieved by performing the following steps: removing the handles 50, 52 by removing the nut fasteners 42 and shoulder bolts 40 which hold the handles 50, 52 to the mobile 22 and stationary 24 clamp portions; inserting a user's 110 finger portions through the finger opening 23 in the mobile clamp portion 22, while concurrently wrapping one (1) or more finger portions around and below the stationary clamp portion 24; squeezing the stationary 24 and mobile 22 clamp portions together to motion the mobile clamp portion 22 downwardly; utilizing the apparatus 10 configured without the handle portions 50, 52 in areas which present a space constraint or other size limitation; slidingly inserting the apparatus 10 over an end portion of the board 100; positioning the apparatus 10 upon the board 100 as previously described; and, clamping and cutting said board 100 as previously described.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. An adjustable carpentry cutting guide for assisting a user to cut an existing board at a desired angle, said adjustable carpentry cutting guide comprising:

a guide plate;

a stationary clamp portion spaced below said guide plate;

a mobile clamp portion spaced between said guide plate and said stationary clamp portion;

first and second guide rod assemblies each attached to said guide plate and said mobile clamp portion and said stationary clamp portion respectively; and, first and second handles each attached to said mobile and stationary clamp portions respectively;

wherein each of said first handle and said second handle includes first, second and third linear segments contiguously affixed at an end-to-end pattern;

wherein said first handle extends along an anterior face of said mobile clamp portion and said stationary clamp portion, respectively;

wherein said second handle extends along a posterior face of said mobile clamp portion and said stationary clamp portion, respectively.

2. The adjustable carpentry cutting guide of claim 1, wherein said guide plate is registered parallel to said mobile clamp portion and is spaced thereabove.

3. The adjustable carpentry cutting guide of claim 1, wherein each said first and second guide rod assemblies extends perpendicularly downward from said guide plate and through said mobile clamp portion respectively.

4. The adjustable carpentry cutting guide of claim 1, wherein a distal bottom end of each said guide rod assemblies is anchored to said stationary clamp portion.

5. The adjustable carpentry cutting guide of claim 1, wherein said mobile clamp portion is located between said guide plate and said stationary clamp portion, said mobile clamp portion being slidably movable along said guide rod assemblies.

6. The adjustable carpentry cutting guide of claim 1, wherein said mobile clamp portion is provided with a finger opening.

7. The adjustable carpentry cutting guide of claim 1, wherein each of said guide rod assemblies comprises:

a linear bolt passing through said stationary and mobile clamp portions;

a first spring positioned about said bolt and located between said mobile clamp portion and said stationary clamp portion, said first spring providing a upward force upon a bottom surface of said mobile clamp portion; and, a second spring positioned about said bolt and located between said guide plate and said mobile clamp portion, said second spring providing a downward force and thereby lowering said mobile clamp portion as said first and second handles are squeezed together.

8. The adjustable carpentry cutting guide of claim 1, wherein first and second proximal end portions of said first and second handles respectively extend outwardly from said stationary and mobile clamp portions.

9. The adjustable carpentry cutting guide of claim 1, wherein said first and second handles are pivotingly attached to said mobile and stationary clamp portions respectively, wherein said first and second handles are pivotingly attached to each other and capable of being squeezed together and thereby resiliently motioning said mobile clamp portion downwardly toward said stationary clamp portion.

10. An adjustable carpentry cutting guide for assisting a user to cut an existing board at a desired angle, said adjustable carpentry cutting guide comprising:

a guide plate capable of being clamped to a top surface of the existing board;

a stationary clamp portion spaced below said guide plate;

a mobile clamp portion spaced between said guide plate and said stationary clamp portion, said mobile clamp portion capable of being engaged with a bottom surface of the existing board, said stationary clamp portion spaced below said mobile clamp portion;

first and second guide rod assemblies each attached to said guide plate and said mobile clamp portion and said stationary clamp portion respectively; and, first and second handles each attached to said mobile and stationary clamp portions respectively;

wherein each of said first handle and said second handle includes first, second and third linear segments contiguously affixed at an end-to-end pattern;

wherein said first handle extends along an anterior face of said mobile clamp portion and said stationary clamp portion, respectively;

wherein said second handle extends along a posterior face of said mobile clamp portion and said stationary clamp portion, respectively.

11. The adjustable carpentry cutting guide of claim 10, wherein said guide plate is registered parallel to said mobile clamp portion and is spaced thereabove.

12. The adjustable carpentry cutting guide of claim 10, wherein each said first and second guide rod assemblies extends perpendicularly downward from said guide plate and through said mobile clamp portion respectively.

13. The adjustable carpentry cutting guide of claim 10, wherein a distal bottom end of each said guide rod assemblies is anchored to said stationary clamp portion.

14. The adjustable carpentry cutting guide of claim 10, wherein said mobile clamp portion is located between said guide plate and said stationary clamp portion, said mobile clamp portion being slidably movable along said guide rod assemblies.

15. The adjustable carpentry cutting guide of claim 10, wherein said mobile clamp portion is provided with a finger opening.

16. The adjustable carpentry cutting guide of claim 10, wherein each of said guide rod assemblies comprises:

a linear bolt passing through said stationary and mobile clamp portions;

a first spring positioned about said bolt and located between said mobile clamp portion and said stationary clamp portion, said first spring providing a upward force upon a bottom surface of said mobile clamp portion; and, a second spring positioned about said bolt and located between said guide plate and said mobile clamp portion, said second spring providing a downward force and thereby lowering said mobile clamp portion as said first and second handles are squeezed together.

17. The adjustable carpentry cutting guide of claim 10, wherein first and second proximal end portions of said first and second handles respectively extend outwardly from said stationary and mobile clamp portions.

18. The adjustable carpentry cutting guide of claim 10, wherein said first and second handles are pivotingly attached to said mobile and stationary clamp portions respectively, wherein said first and second handles are pivotingly attached to each other and capable of being squeezed together and thereby resiliently motioning said mobile clamp portion downwardly toward said stationary clamp portion.

19. A method of utilizing an adjustable carpentry cutting guide for assisting a user to cut an existing board at a desired angle, said method comprising the steps of:

providing and clamping a guide plate to a top surface of the existing board;

providing and spacing a stationary clamp portion below said guide plate;

providing and spacing a mobile clamp portion between said guide plate and said stationary clamp portion;

engaging said mobile clamp portion with a bottom surface of the existing board;

spacing said stationary clamp portion below said mobile clamp portion;

providing and attaching first and second guide rod assemblies to said guide plate and said mobile clamp portion and said stationary clamp portion respectively; and, providing and attaching first and second handles to said mobile and stationary clamp portions respectively;

wherein each of said first handle and said second handle includes first, second and third linear segments contiguously affixed at an end-to-end pattern;

wherein said first handle extends along an anterior face of said mobile clamp portion and said stationary clamp portion, respectively;

wherein said second handle extends along a posterior face of said mobile clamp portion and said stationary clamp portion, respectively.

* * * * *